US011879196B2

(12) United States Patent
Yamashita et al.

(10) Patent No.: US 11,879,196 B2
(45) Date of Patent: Jan. 23, 2024

(54) EMBROIDERY DEVICE

(71) Applicants: Hiroyuki Yamashita, Kanagawa (JP); Shinya Tanaka, Kanagawa (JP); Yusuke Komine, Kanagawa (JP); Taito Omura, Kanagawa (JP); Yuuki Gotoh, Kanagawa (JP); Kaoru Satoh, Kanagawa (JP)

(72) Inventors: Hiroyuki Yamashita, Kanagawa (JP); Shinya Tanaka, Kanagawa (JP); Yusuke Komine, Kanagawa (JP); Taito Omura, Kanagawa (JP); Yuuki Gotoh, Kanagawa (JP); Kaoru Satoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 110 days.

(21) Appl. No.: 17/485,505

(22) Filed: Sep. 27, 2021

(65) Prior Publication Data

US 2022/0098776 A1 Mar. 31, 2022

(30) Foreign Application Priority Data

Sep. 30, 2020 (JP) ..... 2020-166414
Jul. 28, 2021 (JP) ..... 2021-123735

(51) Int. Cl.

| | |
|---|---|
| ***D05C 11/16*** | (2006.01) |
| ***D05C 11/24*** | (2006.01) |
| ***D05C 11/20*** | (2006.01) |
| ***D05C 5/02*** | (2006.01) |

(52) U.S. Cl.
CPC ..... *D05C 11/16* (2013.01); *D05C 5/02* (2013.01); *D05C 11/20* (2013.01); *D05C 11/24* (2013.01)

(58) Field of Classification Search
CPC ..... D05C 11/16; D05C 5/02; D05C 11/20; D05C 11/24
See application file for complete search history.

(56) References Cited

U.S. PATENT DOCUMENTS

| | | | | | |
|---|---|---|---|---|---|
| 5,040,476 | A * | 8/1991 | Takenoya | D05B 19/12 | 112/168 |
| 5,284,104 | A * | 2/1994 | Hori | D05B 19/12 | 112/102.5 |
| 5,666,894 | A * | 9/1997 | Jonsson | D05B 3/243 | 112/103 |
| 5,885,679 | A * | 3/1999 | Yasue | D06H 5/00 | 428/57 |
| 6,158,365 | A * | 12/2000 | Hidechika | D05B 21/00 | 112/103 |

(Continued)

FOREIGN PATENT DOCUMENTS

| | | |
|---|---|---|
| JP | 6-299458 | 10/1994 |
| JP | 6-304359 | 11/1994 |

(Continued)

*Primary Examiner* — Danny Worrell
(74) *Attorney, Agent, or Firm* — XSENSUS LLP

(57) ABSTRACT

An embroidery device includes a needle including a hole through which a thread has been passed, a dyeing unit configured to dye the thread in different colors, an embroidery unit configured to move the needle to perform a sewing process on a medium with the thread dyed in the different colors by the dyeing unit, and a remover configured to remove the linear member in a vicinity of the needle.

17 Claims, 9 Drawing Sheets

(56) References Cited

U.S. PATENT DOCUMENTS

| | | | | |
|---|---|---|---|---|
| 6,293,212 | B1 * | 9/2001 | Ebata | D05B 21/00 112/168 |
| 8,051,787 | B2 * | 11/2011 | Hidechika | D05B 69/30 112/102.5 |
| 2007/0119354 | A1 * | 5/2007 | Ukai | D05B 21/00 112/78 |
| 2007/0204779 | A1 * | 9/2007 | Naka | D05B 21/00 112/470.04 |
| 2012/0060732 | A1 * | 3/2012 | Viltrakis | D05C 9/04 112/103 |
| 2018/0320301 | A1 * | 11/2018 | Kawaguchi | D05C 9/04 |
| 2019/0299692 | A1 | 10/2019 | Toda et al. | |
| 2020/0171846 | A1 | 6/2020 | Hayashi et al. | |
| 2020/0171854 | A1 | 6/2020 | Sunaoshi et al. | |
| 2020/0207117 | A1 | 7/2020 | Ikegami | |
| 2020/0276839 | A1 | 9/2020 | Satoh et al. | |
| 2021/0023837 | A1 | 1/2021 | Nagasu et al. | |
| 2021/0162737 | A1 | 6/2021 | Miura et al. | |
| 2022/0098775 | A1 * | 3/2022 | Osamura | D05C 9/04 |

FOREIGN PATENT DOCUMENTS

| | | |
|---|---|---|
| JP | 6-305129 | 11/1994 |
| JP | 2002-035462 | 2/2002 |
| JP | 2002-200380 | 7/2002 |
| JP | 2002-200382 | 7/2002 |
| JP | 2005-034237 | 2/2005 |
| JP | 2008-289521 | 12/2008 |
| JP | 2008-289522 | 12/2008 |
| JP | 2009-273675 | 11/2009 |
| JP | 2020-108961 | 7/2020 |
| JP | 2021-084404 | 6/2021 |

* cited by examiner

EMBROIDERY DEVICE

CROSS-REFERENCE TO RELATED APPLICATIONS

This patent application is based on and claims priority pursuant to 35 U.S.C. § 119(a) to Japanese Patent Application No. 2020-166414, filed on Sep. 30, 2020, in the Japan Patent Office and Japanese Patent Application No. 2021-123735, filed on Jul. 28, 2021, in the Japan Patent Office, the entire disclosures of which are hereby incorporated by reference herein.

BACKGROUND

Technical Field

Aspect of this disclosure relates to an embroidery device.

Related Art

An embroidery device performs embroidery using, for example, an embroidery thread as a linear member. The embroidery device performs embroidery according to embroidery information by performing sewing on the embroidery medium with a single thread dyed in different colors according to dyeing information.

SUMMARY

In an aspect of this disclosure, an embroidery device includes a needle including a hole through which a thread has been passed, a dyeing unit configured to dye the thread in different colors, an embroidery unit configured to move the needle to perform a sewing process on a medium with the thread dyed in the different colors by the dyeing unit, and a remover configured to remove the linear member in a vicinity of the needle.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
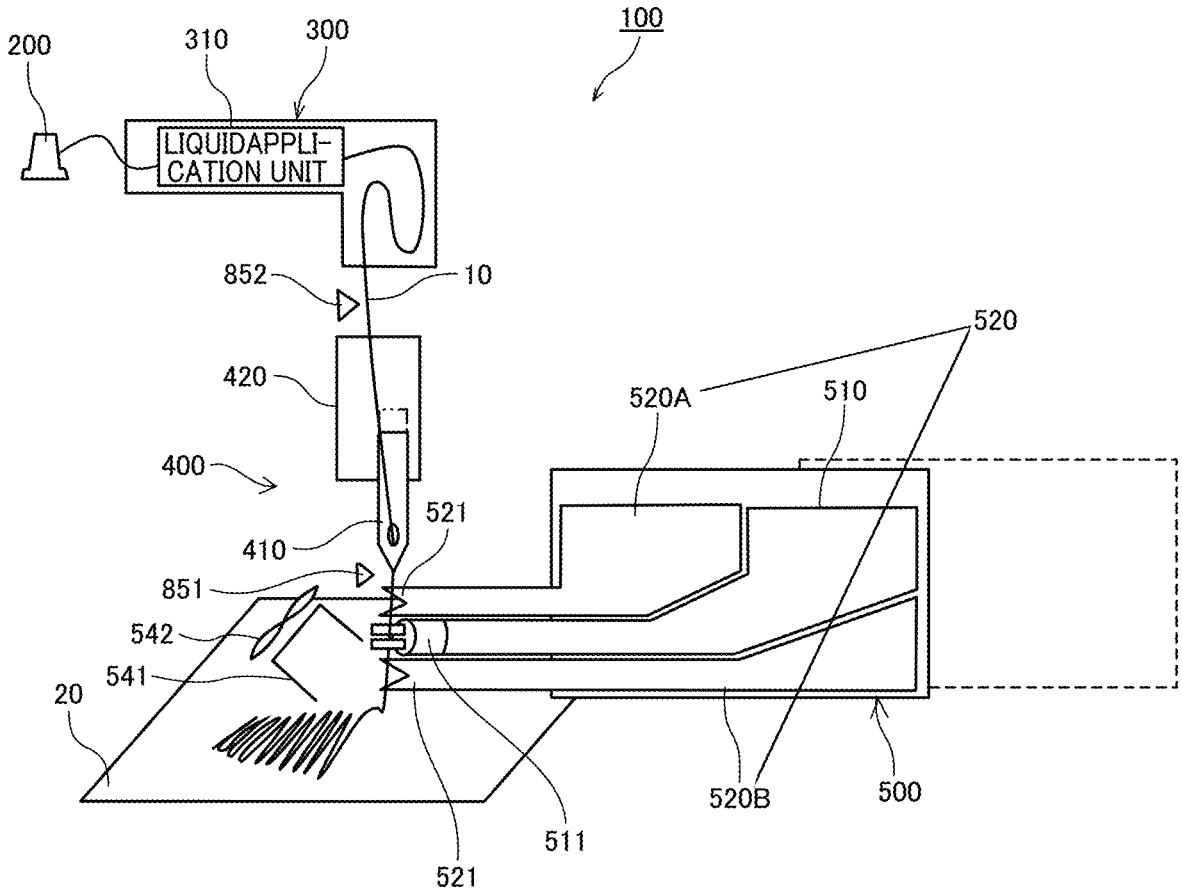
FIG. 1 is a schematic cross-sectional side view of an embroidery device using a linear member according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

An embroidery device as a device using a linear member according to a first embodiment of the present disclosure is described with reference to FIG. 1.

FIG. 1 is a schematic cross-sectional side view of an embroidery device 100.

The embroidery device 100 includes a supply unit 200 that supplies a thread 10 as a linear member and a dyeing unit 300 that dyes (colors) the thread 10 in a predetermined color. The, the embroidery device 100 includes an embroidery unit 400 as a sewing device and a remover 500. The embroidery unit 400 as a sewing device performs a sewing process (embroidery process) on a medium 20 with the thread 10 using a needle 410 through which the thread 10 passes. The remover 500 as a remover to remove the thread 10 to be sewn on the medium 20 in a vicinity of the needle 410.

The supply unit 200 supplies the uncolored thread 10 to the dyeing unit 300. Also note that a term "thread" includes at least one of glass fiber thread, wool thread, cotton thread, synthetic fiber thread, metallic thread, mixed thread of wool, cotton, polymer, or metal, yarn, a filament, and a linear member (continuous member) to which a liquid is applicable. The thread may include a cord (string) such as braid or a flat string is also included.

The thread 10 drawn from the supply unit 200 is continuously routed from the supply unit 200 to the needle 410 of the embroidery unit 400 via the dyeing unit 300.

The dyeing unit 300 includes a liquid application unit 310 that applies a liquid of predetermined color onto the thread 10 drawn and conveyed from the supply unit 200 to the dyeing unit 300. The liquid application unit 310 includes multiple heads or the like that discharges the liquid of predetermined color. The liquid application unit 310 includes the heads that respectively discharge, for example, cyan (C), magenta (M), yellow (Y), and black (K) color liquids.

The dyeing unit 300 may include a fixing unit in addition to the liquid application unit 310. The fixing unit performs a fixing process (drying process) on the thread 10 onto which the liquid discharged (applied) from the liquid application unit 310 has been applied. The fixing unit includes a heater, for example, an infrared irradiator and an air blower to heat and dry the thread 10.

The dyeing unit 300 may include, for example, a cleaner, a tension adjuster, a feed amount detector, and a lubricant applicator. The cleaner cleans the thread 10. The tension adjuster adjusts a tension of the thread 10. The feed amount detector detects a moving amount of the thread 10. The lubricant applicator applies a lubricant onto a surface of the thread 10.

The embroidery unit 400 includes a needle 410 (embroidery needle) and a needle driver 420 (needle drive mechanism). The embroidery unit 400 vertically movably supports the needle 410. The needle driver 420 vertically moves the needle 410. The embroidery unit 400 sews the dyed thread 10 as an upper thread on the medium 20 (embroidery medium) such as cloth according to an embroidery pattern.

The remover 500 includes a winding collector 510 that winds and collects the thread 10 serving as the upper thread to be sewn on the medium 20 after passing through a hole of the needle 410. Further, the remover 500 includes a first upper thread cutter 520A and a second upper thread cutter 520B to cut the thread 10 serving as the upper thread.

The first upper thread cutter 520A and the second upper thread cutter 520B are collectively referred to as "upper thread cutter 520" when the first upper thread cutter 520A and the second upper thread cutter 520B are not distinguished from each other. The remover 500 is movable between a winding and cutting position indicated by a solid line and a standby position away from the needle 410 as indicated by a broken line.

The winding collector 510 includes a winder 511 to wind the thread 10 in the vicinity of the needle 410.

The first upper thread cutter 520A cuts the thread 10 on an upstream of the winding collector 510. The second upper thread cutter 520B cuts the thread 10 on a downstream of the winding collector 510. The upper thread cutter 520 includes a thread cutter 521 at a leading end of the upper thread cutter 520.

The upper thread cutter 520 further includes a storage 541, a suction device 542, and the thread cutter 521. The storage 541 stores an excess thread 10. The suction device 542 sucks the thread 10 into the storage 541. The thread cutter 521 cuts off the thread 10. The storage 541 and the suction device 542 may be formed together with the remover 500 as a single unit. The storage 541 and the suction device 542 may be separated from the remover 500.

The embroidery device 100 may be divided and separated into two parts including a first part and a second part. The first part includes the supply unit 200 and the dyeing unit 300. The second part includes the embroidery unit 400 and the remover 500.

Next, an example of the winder of the winding collector 510 is described with reference to FIGS. 2A and 2B.

Figure 2A:
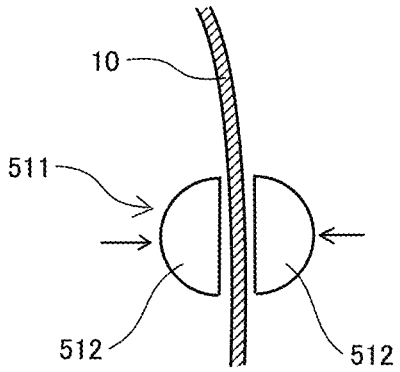
FIGS. 2A and 2B are schematic side views of an example of a winder of a winder collector.
Figure 2B:
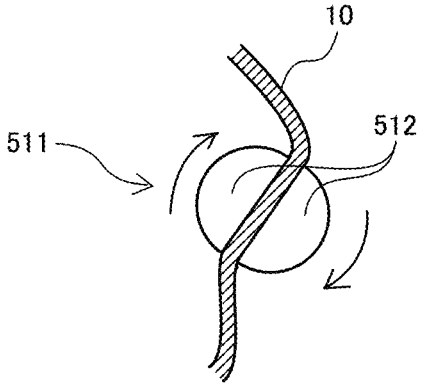

FIGS. 2A and 2B are schematic side views of an example of the winder.

The winder 511 includes a clamp 512 to clamp the thread 10. The clamp 512 is approachable to and separatable from the thread 10. The winder 511 rotatably hold the clamp 512. A shape of the clamp 512 is not limited to a half-moon shape as illustrated in FIGS. 2A and 2B. The clamp 512 may have a shape of a triangular shape, a rectangular shape, or the like.

As illustrated in FIG. 2A, when the thread 10 is to be removed (wound), the winder 511 moves the clamp 512 toward the thread 10 as indicated by arrow in FIG. 2A to clamp the thread 10. Then, the winder 511 rotates the clamp 512 as indicated by arrow in FIG. 2B to wind the thread 10 around the clamp 512 as illustrated in FIG. 2B.

Next, an example of the thread cutter 521 of the upper thread cutter 520 is described with reference to FIG. 3.

Figure 3:
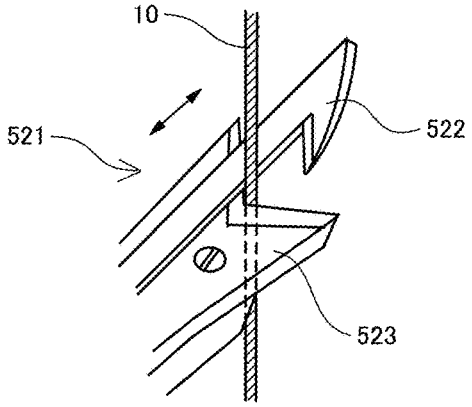
FIG. 3 is a schematic perspective view of an example of the thread cutter of upper thread cutter.

FIG. 3 is a schematic side view of an example of the thread cutter 521.

The thread cutter 521 includes a mobile blade 522 and a fixed blade 523. the mobile blade 522 has a sickle shape and is movable in a direction indicated by arrow in FIG. 3. The fixed blade 523 has a bifurcated shape.

When the remover 500 cuts the thread 10, the remover 500 slides the thread 10 to an outer inclination part of the mobile blade 522, moves the thread 10 between the fixed blade 523 and the mobile blade 522, and slides the mobile blade 522 toward the fixed blade 523. Thus, the thread 10 is sandwiched between the fixed blade 523 and the mobile blade 522 so that the thread 10 is cut by the fixed blade 523 and the mobile blade 522.

Figure 4A:
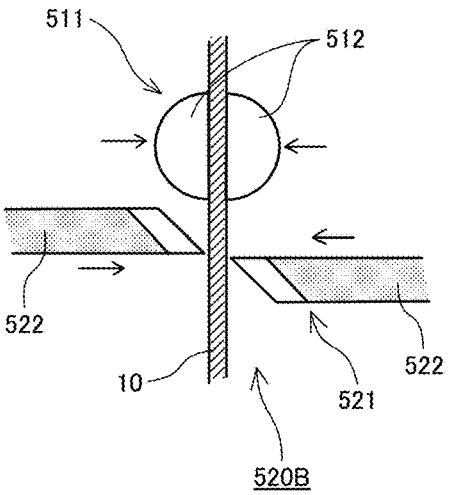
FIGS. 4A and 4B are schematic side views of the example of the combination of the winding collector and the upper thread cutter.
Figure 4B:
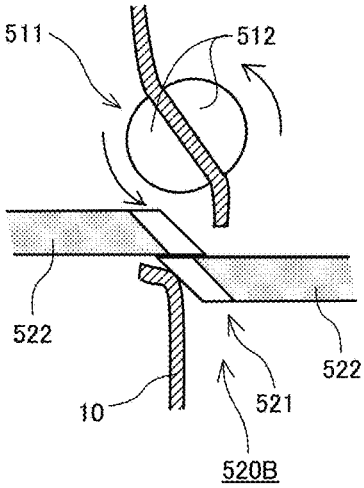

Next, an example of a combination of the winding collector 510 and the upper thread cutter 520 is described with reference to FIGS. 4A and 4B. FIGS. 4A and 4B are schematic side views of the example of the combination of the winding collector 510 and the upper thread cutter 520.

The remover 500 includes the thread cutter 521 of the second upper thread cutter 520B downstream of the winder 511. The winder 511 is a device that uses the clamp 512 as in FIGS. 2A and 2B as described above. The thread cutter 521 includes two mobile blades 522.

In this example, the remover 500 clamps the thread 10 with the clamp 512 of the winder 511 and moves the mobile blade 522 of the thread cutter 521 of the second upper thread cutter 520B while clamping the thread 10 with the clamp 512 to cut the thread 10 as illustrated in FIG. 4A. Then, the remover 500 rotates the clamp 512 of the winder 511 to wind the thread 10 as illustrated in FIG. 4B.

Thus, the remover 500 cuts the thread 10 by the second upper thread cutter 520B downstream of the winder 511 without winding the thread 10 that has been embroidered on the medium 20. Then, the remover 500 winds an unused part (upstream of winder 511) of the thread 10 by the winder 511 until a color of the thread 10 changes to a predetermined color.

Then, the remover 500 cuts the thread 10 with the first upper thread cutter 520A upstream of the winder 511. Then, the embroidery device 100 starts an embroidery (sewing) process using the thread 10 dyed to a next predetermined color.

Next, another example of a combination of the winding collector 510 and the upper thread cutter 520 is described with reference to FIGS. 5A and 5B.

Figure 5A:
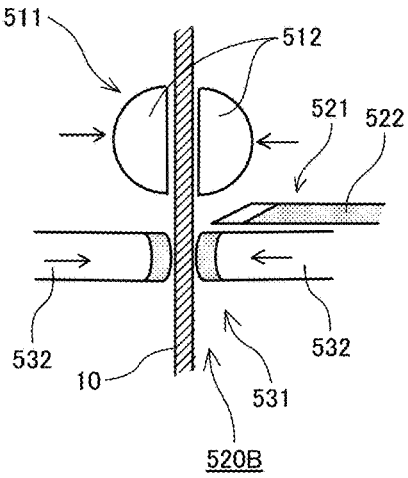
FIGS. 5A and 5B are schematic side views of another example of a combination of the winding collector and the upper thread cutter.
Figure 5B:
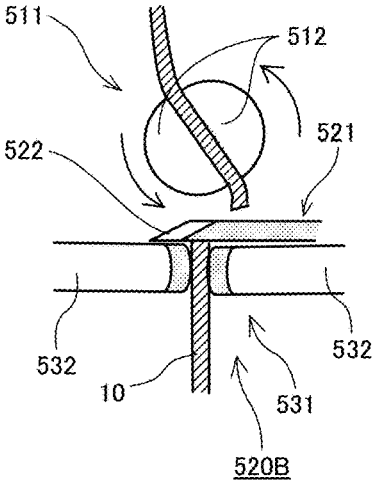

FIGS. 5A and 5B are schematic side views of said another example of the combination of the winding collector 510 and the upper thread cutter 520.

The remover 500 includes the thread cutter 521 of the second upper thread cutter 520B disposed downstream of the winder 511. The remover 500 includes a holder 531 in the thread cutter 521. The holder 531 holds the thread 10 at a position adjacent to the thread cutter 521 in a moving direction of the thread 10. The winder 511 is a device that uses the clamp 512 as in FIGS. 2A and 2B as described above. The thread cutter 521 includes a mobile blade 522 that moves along the holding members 532 of the holder 531.

In this example, the remover 500 moves the holding members 532 of the holding members 532 in FIG. 5A in a lateral direction toward the thread 10 indicated by arrow. Further, the remover 500 clamps the thread 10 by the holding members 532 of the holder 531 as illustrated in FIG. 5B b. The clamp 512 of the winder 511 is moved in the direction of the arrow to clamp the thread 10.

Then, the remover 500 moves the mobile blade 522 of the thread cutter 521 while clamping the thread 10 by the holding members 532 of the holder 531 to cut the thread 10. Then, the remover 500 rotates the clamp 512 of the winder 511 to rotate and wind the thread 10.

In this example also, the remover 500 cuts the thread 10 by the second upper thread cutter 520B downstream of the winder 511 without winding the thread 10 that has been embroidered. Then, the remover 500 winds an unused part (upstream of winder 511) of the thread 10 by the winder 511 until a color of the thread 10 changes to a predetermined color.

Then, the remover 500 cuts the thread 10 with the first upper thread cutter 520A upstream of the winder 511. Then, the embroidery device 100 starts the embroidery (sewing) process using the thread 10 dyed to a next predetermined color.

Figure 6:
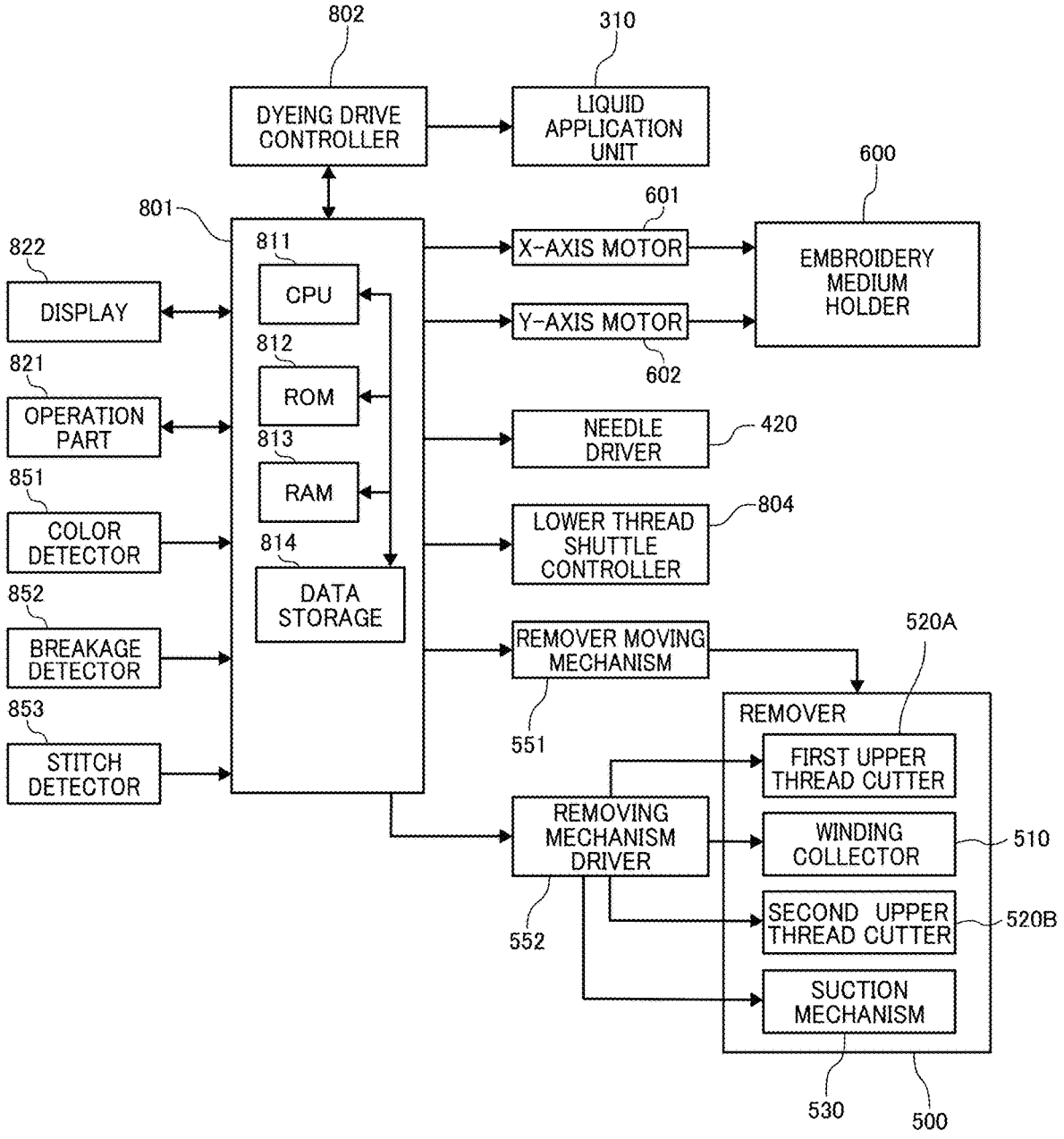
FIG. 6 is a block diagram illustrating a schematic configuration of a controller of the embroidery device.

FIG. 6 is a block diagram illustrating a schematic configuration of a controller of the embroidery device 100.

The main controller 801 (circuitry) controls entire system of the embroidery device 100. The main controller 801 includes a central processing unit 811 (CPU), a read only memory 812 (ROM), a random access memory 813 (RAM), and a data storage 814, and the like. The data storage 814 stores embroidery information, dyeing information (printing information), and the like.

The dyeing drive controller 802 drives and controls each head of the liquid application unit 310 according to the dyeing information from the main controller 801 to dye (color) the thread 10 in a predetermined color.

The main controller 801 drives and controls an X-axis motor 601 and a Y-axis motor 602 to control a movement of an embroidery medium holder 600 in an X direction and a Y direction to move an embroidery position of the medium 20 (embroidery medium) held by the embroidery medium holder 600 to a position directly below the needle 410.

The main controller 801 drives and controls the needle driver 420 to vertically move the needle 410. When the main controller 801 vertically moves the needle 410, the main controller 801 controls a lower thread shuttle via a lower thread shuttle controller 804.

The main controller 801 drives and controls a remover moving mechanism 551 to reciprocally move the remover 500 between a standby position indicated by a broken line and a removing position indicated by a solid line in FIG. 1. The main controller 801 drives and controls a removing mechanism driver 552 to control the winding collector 510, the first upper thread cutter 520A, and the second upper thread cutter 520B of the remover 500 to perform winding, collecting, and thread cutting processes.

The main controller 801 drives and controls the removing mechanism driver 552 to drive and control the suction mechanism 530 including the suction device 542 and the storage 541 to control suction and storage of the thread 10 to be collected.

The main controller 801 inputs various types of information used for embroidering an embroidery pattern including colors such as embroidery information and dyeing information from an operation part 821. The main controller 801 displays various information via the display 822.

The main controller 801 receives color detection information from a color detector 851 that detects a color of the thread 10. As illustrated in FIG. 1, the color detector 851 is disposed at a position to detect a color of the thread 10 that has been passed through the needle 410, for example. The main controller 801 receives break information from a breakage detector 852 to detect breakage of the thread 10. As illustrated in FIG. 1, the breakage detector 852 is disposed at a position to detect breakage of the thread 10 before the thread 10 enters the needle 410 or when the thread 10 is in the dyeing unit 300, for example.

The main controller 801 receives a detection signal from stitch detector 853 to detect a stitch.

The stitch detector 853 is described with reference to FIG. 7.

Figure 7:
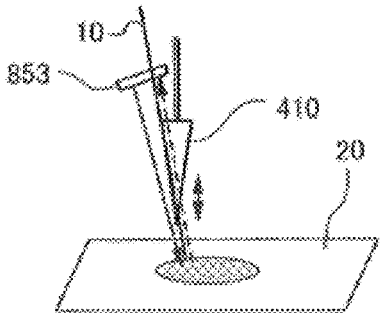
FIG. 7 is a schematic side view of an example of the stitch detector.

FIG. 7 is a schematic side view of an example of the stitch detector 853.

The stitch detector 853 is, for example, a color laser sensor. The color laser sensor is a type of photoelectric sensor that emits light from a light projector and detects light reflected by a detection object by a light receiver. Since the color laser sensor can detect an amount of light received of each color of red, blue, and green, the stitch detector 853 can determine a color of the object such as a color of the needle 410 and the thread 10.

The color laser sensor of the stitch detector 853 sets a needle drop position at which the needle 410 pierces the medium 20 as an irradiation range of the object. At a moment when the needle 410 pierces the medium 20, the color laser sensor of the stitch detector 853 detects a time of piercing of the needle 410 and a color of the thread 10. Thus, the stitch detector 853 can count a number of times of needle drop to detect a number of stitches. Further, the stitch detector 853 can simultaneously detect a color of the thread 10 at a timing used for forming a seam (stitch) on the medium 20.

Alternatively, the stitch detector 853 may be used only to detect a color of the thread 10 including one color laser sensor. The main controller 801 calls the number of stitches corresponding to a current position. The color laser sensor of the stitch detector 853 detects a color of the thread 10 at a timing of needle drop when the needle 410 pierces the medium 20. The main controller 801 may associate the number of stitches with the color of the thread 10.

Next, an effect of the remover 500 of the embroidery device 100 according to the first embodiment is described below.

When the embroidery device 100 starts embroidery, the main controller 801 of the embroidery device 100 moves the remover 500 to the removing position as illustrated in FIG. 1. Then, the remover 500 winds and pulls out the thread 10 by the winder 511 of the winding collector 510 until the thread 10 dyed in a predetermined color passes through the needle 410 after the dyeing unit 300 starts dyeing the thread 10.

The winder 511 winds the thread 10, and the first upper thread cutter 520A cuts the thread 10 when thread 10 dyed in the predetermined color passes through the needle 410. The color detector 851 can detect whether a portion of the thread 10 dyed in a predetermined color has passed through the needle 410, for example. Then, the main controller 801 of the embroidery device 100 moves the remover 500 back to the standby position and collects and removes an excess thread 10 until a color of the thread 10 becomes (changes to) the predetermined color.

Thus, the embroidery device 100 can starts the embroidery from a predetermined color.

When the thread 10 is cut in the middle of the embroidery process, the remover 500 can collect and remove the thread 10 of an overlapped color and a dyed thread 10 that has become unusable in the vicinity of the needle 410. Thus, the remover 500 can accurately remove the thread 10 without excess or deficiency.

Further, the remover 500 removes an excessive portion of the thread 10 in the vicinity of the needle 410 until a color of the thread 10 changes to (becomes) a next color after finishing an embroidery of a predetermined color not only when the embroidery is started or the thread is cut, but also when it is preferred to accurately represent (embroider) a color switching portion of the thread 10 on the medium 20. Thus, the embroidery device 100 can accurately adjust a color changing position on the thread 10 and achieve target color change of the thread 10.

The embroidery device 100 includes the remover 500 to remove a linear member such as the thread 10 in the vicinity of the needle 410. Thus, the embroidery device 100 can dye the thread 10 in a target color in the sewing process and thus can produce an intended finished product in the sewing process.

The embroidery device 100 can solve a problem caused when a single thread is used while being dyed to efficiently perform embroidery. Further, the embroidery device 100 can perform embroidery with good repeatability and reproducibility in accordance with the dyeing and embroidery data.

Although the thread 10 (linear member) passed through the needle 410 is pulled out (drawn) by the winder 511, a device to pull out the thread 10 (linear member) passed through the needle 410 is not limited to the winder 511.

An embroidery device 100 according to a second embodiment of the present disclosure is described with reference to FIGS. 8A to 8E and FIG. 9.

FIGS. 8A to 8E is schematic side views of a portion of the embroidery device 100 illustrating a start of the sewing process according to the second embodiment.

Figure 8A:
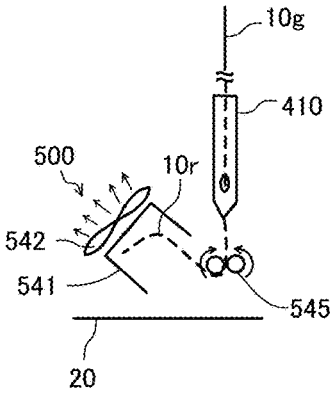
FIGS. 8A to 8E is a schematic side views of a portion of the embroidery device illustrating a start of a sewing process according to a second embodiment of the present disclosure.
Figure 8B:
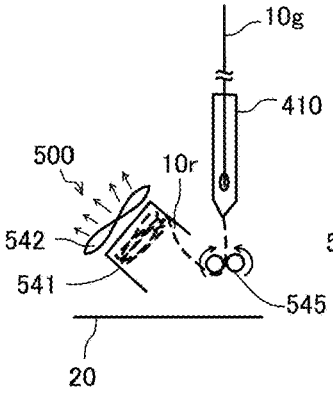
Figure 8C:
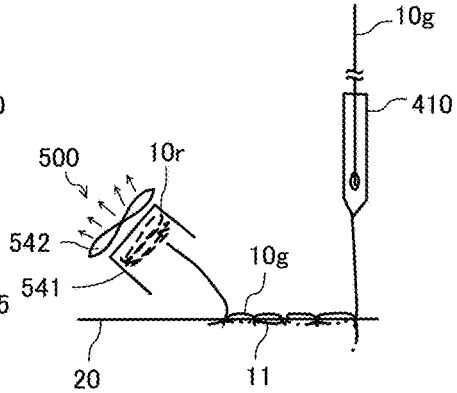
Figure 8D:
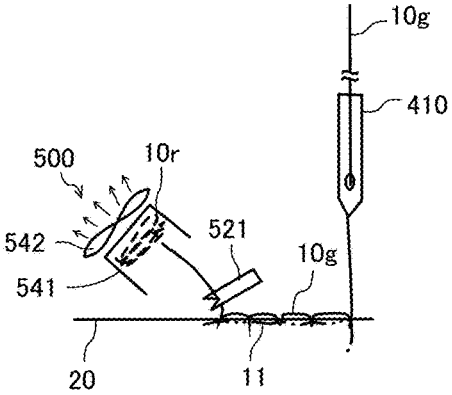
Figure 8E:
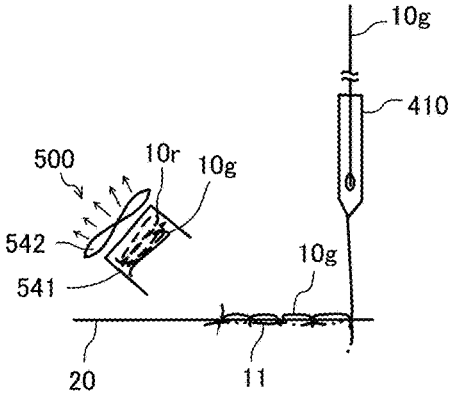
Figure 9:
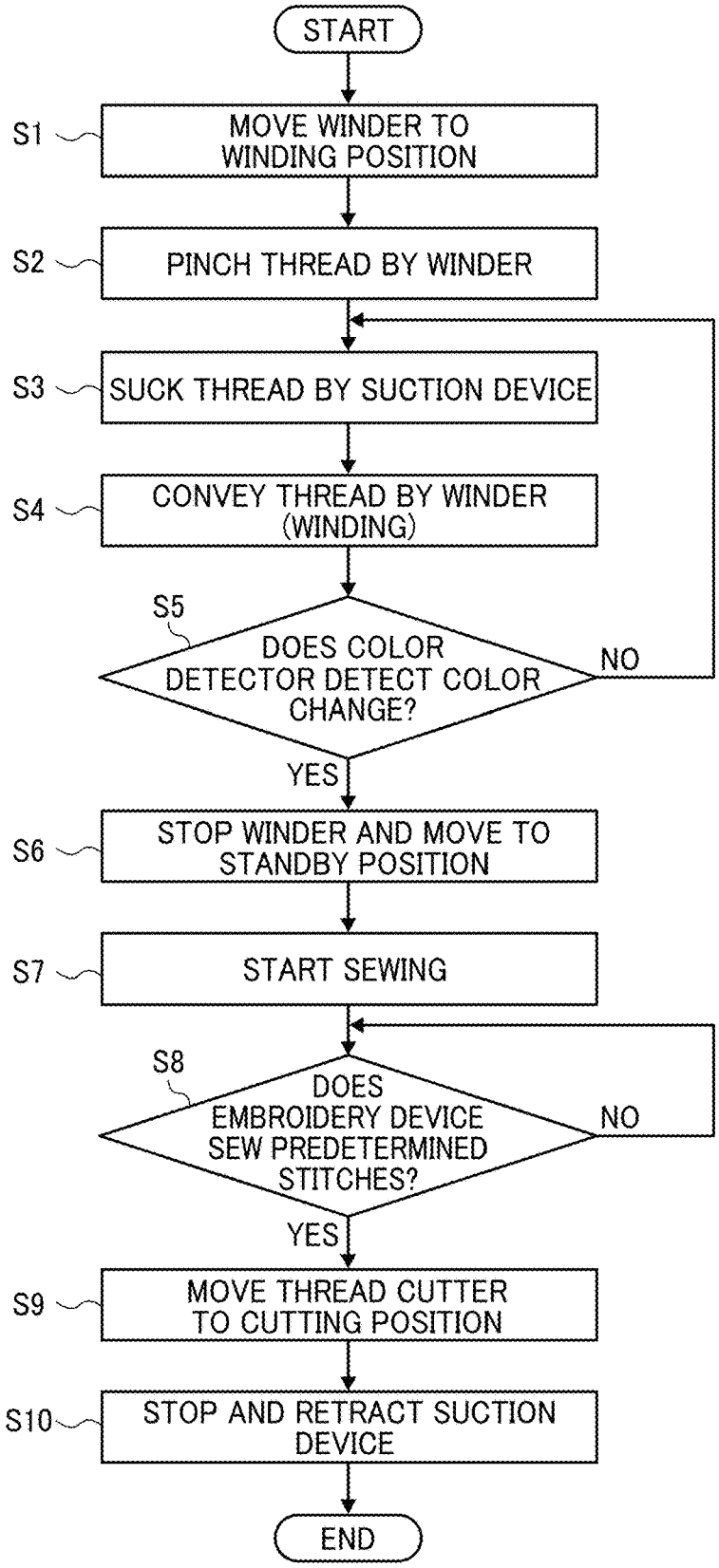
FIG. 9 is a flowchart illustrating a control of a sewing process according to the second embodiment including processes illustrated in FIGS. 8A to 8E.

FIG. 9 is a flowchart illustrating a control of the sewing process including processes illustrated in FIGS. 8A to 8E.

The remover 500 according to the second embodiment also includes the storage 541, the suction device 542, and the thread cutter 521. The storage 541 stores an excess thread 10. The suction device 542 sucks the thread 10 into the storage 541. The thread cutter 521 cuts off the thread 10.

The remover 500 according to the second embodiment also pulls out (draws) an excess upper thread (thread 10) and stores the excess upper thread (thread 10) in the storage 541 of the remover 500 until the thread 10 dyed by a color used for a next start of the sewing process appears. The next start of the sewing process includes restart by cutting of the thread 10 and restart by color switching. Thus, the remover 500 prevents an excessive part of a thread 10 from being embroidered (sewn) on the medium 20.

For example, in FIG. 8, it is assumed that a portion indicated by a broken line of the thread 10 is a red portion 10*r*, and a portion indicated by a solid line is a green portion 10*g*. Further, it is assumed that the sewing process is started using the green portion 10*g* and a lower thread 11. At the time of start of the sewing process, as illustrated in FIGS. 8A and 8B, the red portion 10*r* of the thread 10 is sucked by the suction device 542 and stored in the storage 541 of the remover 500.

As illustrated in FIG. 8C, the embroidery device 100 starts the sewing process from the green portion 10*g* as indicated by solid line in FIG. 8C. The excessive green portion 10*g* at the beginning (start) of the sewing process is cut by the thread cutter 521 as illustrated in FIG. 8D. The excessive green portion 10*g* cut by the thread cutter 521 is removed by the remover 500. That is, the excessive green portion 10*g* is suctioned by the suction device 542 and stored in the storage 541 of the remover 500 as illustrated in FIG. 8E.

Referring to FIG. 9, when the sewing process is started, the main controller 801 moves the winder 511 to a winding position (step S1) in the vicinity of the needle 410. Hereinafter, the "step S1" is simply referred to as "S1". Then, the winder 511 pinches the thread 10 (S2). Then, the suction device 542 sucks the thread 10 (S3).

Next, the winder 511 conveys (winds) the thread 10 (S4), and the main controller 801 determines whether the color detector 851 detects a color change (S5). When the color detector 851 does not detect the color change (S5, NO), the main controller 801 returns the sewing process to step S3.

When the color detector 851 detects the color change (S5, YES), the main controller 801 stops the winding process of the winder 511. Then, the main controller 801 moves the winder 511 to the standby position (S6).

Then, the main controller 801 of the embroidery device 100 starts the sewing process (S7). Then, the main controller 801 determines whether a predetermined stitch has been sewn based on a detection result of the stitch detector 853 (S8). Then, the main controller 801 repeats the sewing process until the predetermined stitch has been sewn (S8, NO).

When the predetermined stitch has been sewn (S8, YES), the main controller 801 moves the thread cutter 521 to the cutting position to cut the thread 10 (S9). Then, the main controller 801 stops and retracts the suction device 542 (S10).

As described above, the remover 500 (removing device) according to the second embodiment includes the winder 511 to wind the thread 10 (linear member) that has passed through the hole of the needle 410. After the winder winds the thread 10 (linear member) until the color of the thread 10 changes to a predetermined color, the main controller 801 moves the winder 511 to the standby position. Then, the embroidery unit 400 (sewing device) of the embroidery device 100 starts to perform a sewing process to sew the medium 20 with the thread 10. Thus, the sewing process may embroider a desired pattern on the medium 20 with the thread 10.

The remover 500 may include a drawer 545 (see FIG. 8B) to pull (draw) out the thread 10 (linear member) having passed through the hole of the needle 410. The drawer 545 includes a pair of rollers facing each other to sandwiching the thread 10 that has been passed through the hole of the needle 410.

The drawer 545 is movable between a drawing position to draw the thread 10 and a standby position.

In the above case, the main controller 801 may move the drawer 545 from the drawing position to the standby position after the drawer 545 pulls (draws) out the thread 10 (linear member) until a color of the thread 10 (linear member) changes to (becomes) a predetermined color. Thus, the embroidery unit 400 (sewing device) of the embroidery device 100 can starts the sewing process.

The embroidery device 100 according to a third embodiment of the present disclosure is described with reference to FIGS. 10A to 10F and FIG. 11.

FIGS. 10A to 10F are schematic side views of a portion of the embroidery unit 400 according to the third embodiment.

Figure 10A:
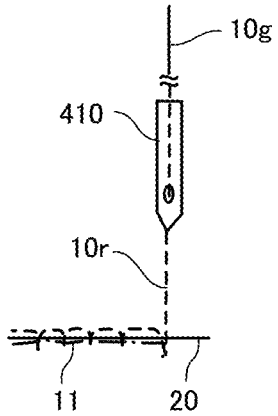
FIGS. 10A to 10F are schematic side views of a portion of the embroidery device according to a third embodiment of the present disclosure.
Figure 10B:
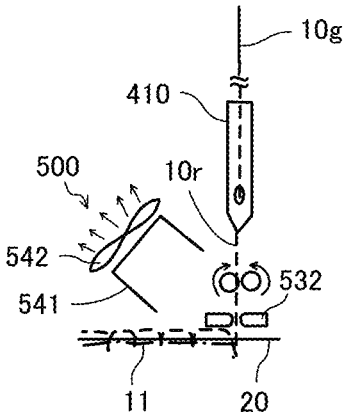
Figure 10C:
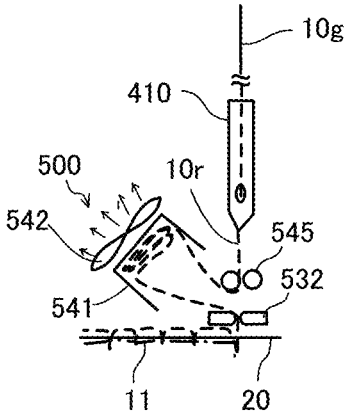
Figure 10D:
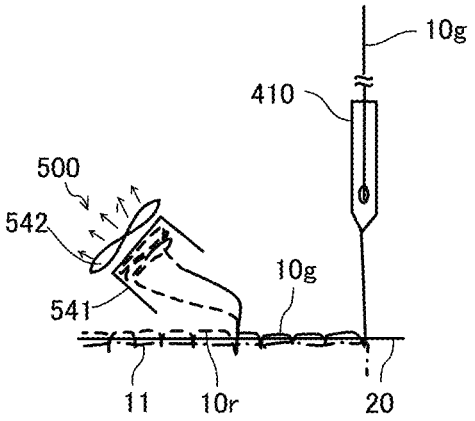
Figure 10E:
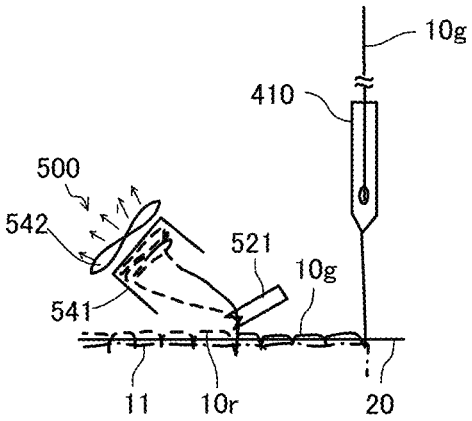
Figure 10F:
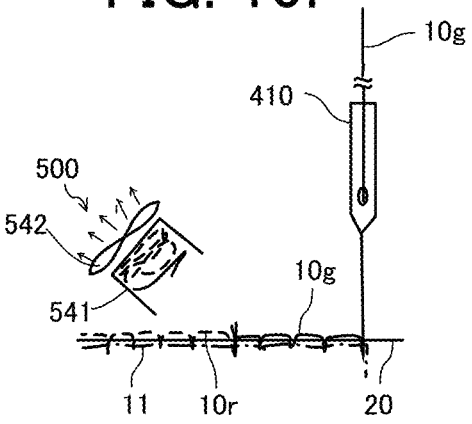
Figure 11:
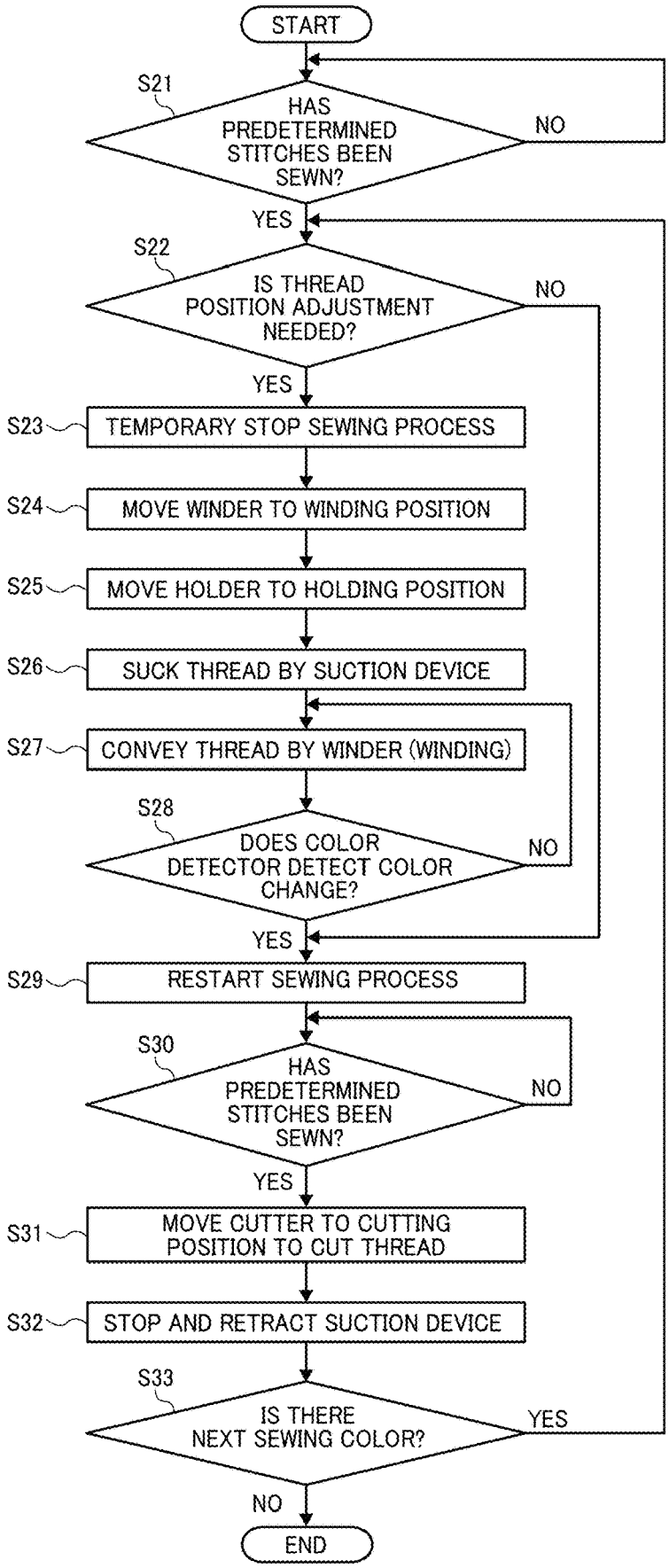
FIG. 11 is a flowchart illustrating a control of the sewing process according to the third embodiment including processes illustrated in FIGS. 10A to 10F.

FIG. 11 is a flowchart illustrating a control of the sewing process including processes illustrated in FIGS. 10A to 10F.

The remover 500 according to the third embodiment also includes the storage 541, the suction device 542, and the thread cutter 521. The storage 541 stores an excess thread 10. The suction device 542 sucks the thread 10 into the storage 541. The thread cutter 521 cuts off the thread 10. Further, the remover 500 includes a holder 531 as described in FIG. 5.

As illustrated in FIG. 10A, when the thread 10 is to be changed from a state in which the red portion 10*r* is sewn to the green portion 10*g*, a sewing end portion of the red portion 10*r* is held by the holding members 532 as illustrated in FIGS. 10B and 10C. Then, an excess red portion 10*r* is sucked by the suction device 542 and stored in the storage 541 of the remover 500, and the drawer pulls out and conveys the green portion 10*g* as illustrated in FIG. 10C.

Then, the embroidery device 100 embroiders (sew) the green portion 10*g* of the thread 10 on the medium 20 as illustrated in FIG. 10D. Then, the thread cutter 521 cuts unused thread 10 as illustrated in FIG. 10E. Then, the unused thread 10 is stored and collected in the storage 541 of the remover 500 as illustrated in FIG. 10F.

Referring to FIG. 11, the main controller 801 determines whether a predetermined stitch has been sewn based on a detection result of the stitch detector 853 (S21). Then, the main controller 801 repeats the sewing process until the predetermined stitch has been sewn (S21, NO).

Then, the main controller 801 detects the color of the thread 10 by the color detector 851 to determine whether it is needed to adjust a thread position (S22). A process of adjusting the thread position is also referred to as a "thread position adjustment".

When the thread position adjustment is needed (S22, YES), the main controller 801 temporarily stops the sewing process (S23). Then, the main controller 801 moves the winder 511 to the winding position (S24). The main controller 801 moves the holder 531 to the holding position and hold the thread 10 (S25).

Then, the main controller 801 drives the suction device 542 to suck the thread 10 and drives the winder 511 to convey (wind) the thread 10 (S27). Then, the main controller 801 determines whether the thread position adjustment has been completed based on whether the color detector 851 detects the color change (S28). When the color detector 851 does not detect the color change (S28, NO), the main controller 801 returns the sewing process to step S27.

The main controller 801 restarts the sewing process (S29) when the thread position adjustment is completed, that is, when the color detector 851 detects the color change (S28, YES). Then, the main controller 801 determines whether a predetermined stitch has been sewn based on a detection result of the stitch detector 853 (S30). Then, the main controller 801 repeats the sewing process until the predetermined stitch has been sewn (S30, NO).

When the main controller 801 determines that the predetermined stitch has been sewn (S30, YES), the main controller 801 moves the thread cutter 521 to the cutting position to cut the thread 10 (S31). Then, the main controller 801 stops and retracts the suction device 542 (S10).

Then, the main controller 801 determines whether there is a next sewing color based on the sewing data (S33). If there is a next sewing color (S33, YES), the main controller 801 returns the process to step S22. If there is no next sewing color (S33, NO), the main controller 801 ends the sewing process.

As described above, the remover 500 (removing device) according to the third embodiment includes the winder 511 to wind the thread 10 (linear member) that has passed through the hole of the needle 410. When the color of the thread 10 (linear member) has to be changed during the sewing process (embroidery process) by the embroidery unit 400 (sewing device), the main controller 801 temporarily stops the sewing process.

A timing when the color of the thread 10 (linear member) has to be changed during the sewing process includes a timing when the embroidery device 100 receives a command of changing a color of the thread 10 during the sewing process.

In this state of temporarily stopping the sewing process, the main controller 801 restarts the sewing process by the embroidery unit 400 (sewing device) after the main controller 801 drives the winder 511 to wind the thread 10 (linear member) until a color of the thread 10 changes to (becomes) a predetermined color.

The remover 500 may include a drawer 545 to pull (draw) out the thread 10 (linear member) having passed through the hole of the needle 410. When it the color of the thread 10 (linear member) has to be changed during the sewing process by the embroidery unit 400 (sewing device), the main controller 801 temporarily stops the sewing process. In this state of temporarily stopping the sewing process, the main controller 801 restarts the sewing process by the embroidery unit 400 (sewing device) after the main controller 801 drives the drawer 545 to pull (draw) out the thread 10 (linear member) until a color of the thread 10 changes to (becomes) a predetermined color.

Next, an embroidery device 100 according to a fourth embodiment of the present disclosure is described with reference to FIG. 12.

Figure 12:
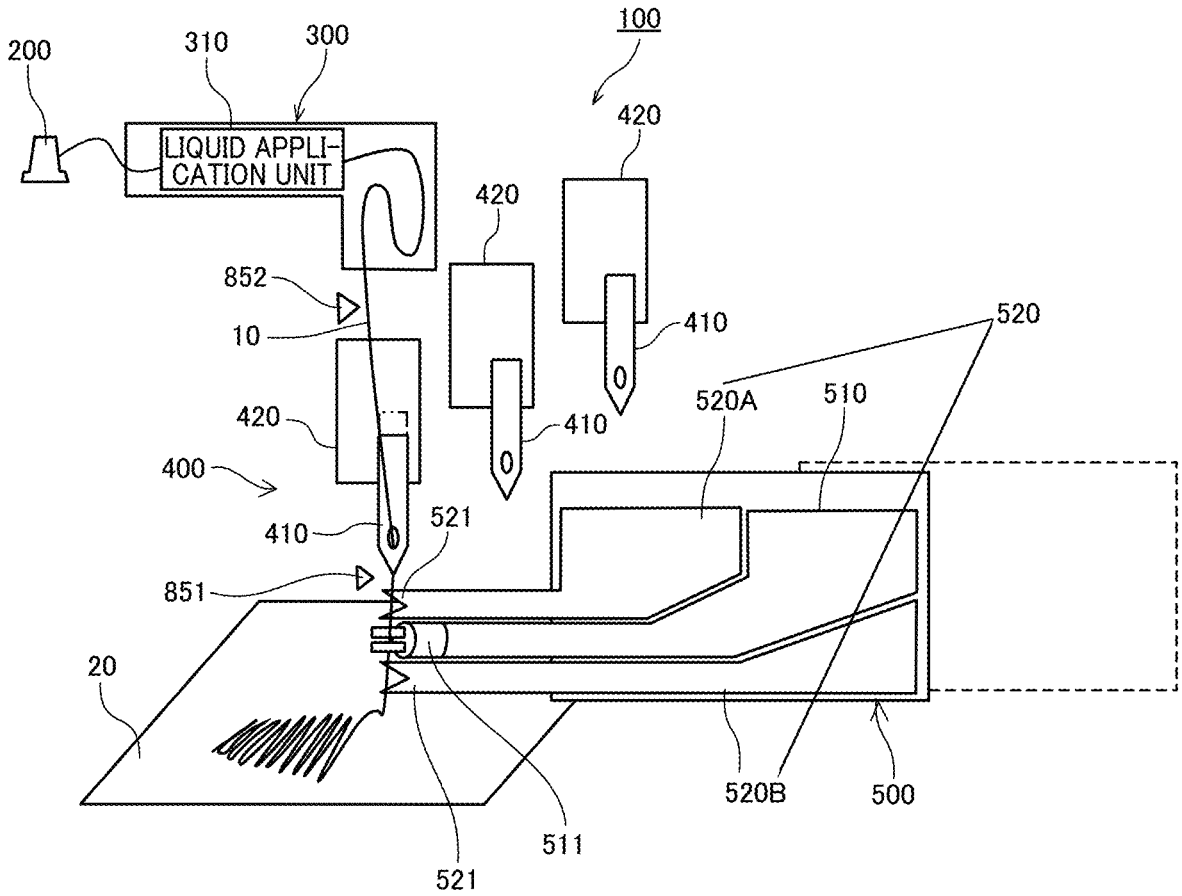
FIG. 12 is a schematic side view of the embroidery device according to the fourth embodiment of the present disclosure.

FIG. 12 is a schematic side view of the embroidery device 100 according to the fourth embodiment of the present disclosure.

The embroidery device 100 according to the fourth embodiment includes multiple needles 410. The embroidery device 100 according to the fourth embodiment has a configuration similar to the embroidery device 100 according to the first embodiment (see FIG. 1) other than the multiple needles 410.

The embroidery unit 400 according to a fifth embodiment of the present disclosure is described with reference to FIGS. 13 and 14.

Figure 13:
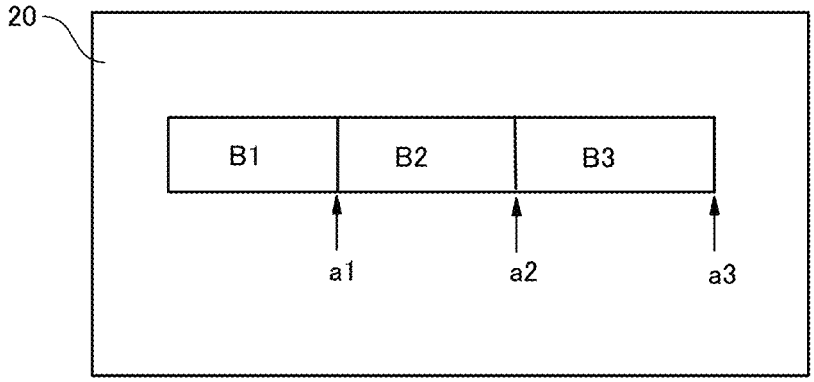
FIG. 13 is a plan view of embroidery on the medium illustrating a sewing process according to a fifth embodiment of the present disclosure.

FIG. 13 is a plan view of embroidery on the medium 20.

Figure 14:
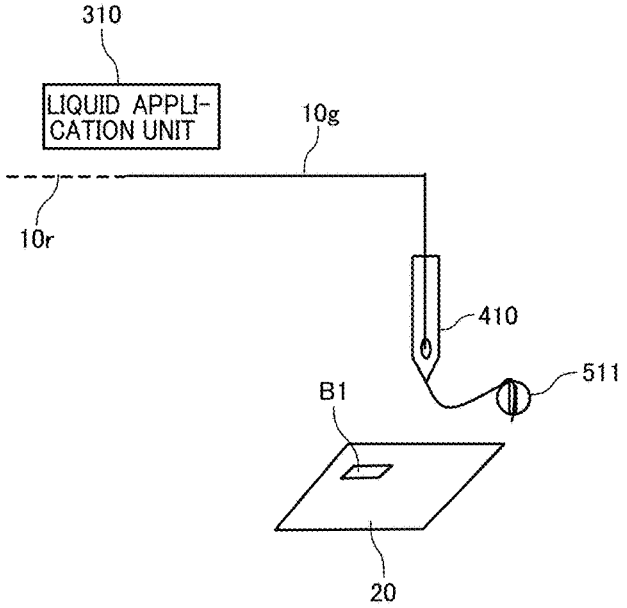
FIG. 14 is a schematic side view of the embroidery device according to the fifth embodiment.

FIG. 14 is a schematic side view of the embroidery device 100 according to the fifth embodiment.

In the embroidery device 100 according to the fifth embodiment, the dyeing information and the embroidery information are divided into blocks. The main controller 801 drives the winder 511 of the winding collector 510 of the remover 500 to wind the thread 10 when embroidering of each block is completed (end of embroidering).

At this time (at time of the end of embroidering), a dyeing length of the thread 10 for dyeing of the thread 10 in one color is longer than an embroidery length of the thread 10 for continuously consuming (embroidering) the thread 10 of said one color.

For example, as illustrated in FIG. 13, the medium 20 is divided into blocks for each color. In an example illustrated in FIG. 13, a block B1 is green, a block B2 is red, and a block B3 is blue.

As illustrated in FIG. 14, the liquid application unit 310 of the dyeing unit 300 applies a liquid of a predetermined color onto the thread 10 to dye the thread 10 in the predetermined color. In this example, the thread 10 used first for embroider the block B1 is dyed in green to form the green portion 10*g*. Then, the thread 10 used second for embroider the block B2 is dyed in red to form the red portion 10*r*. At this time, a length of the green portion 10*g* of the thread 10 (dyeing length) is made longer (redundant) than a length of the thread 10 used for embroidering the block B1 (embroidery length).

Then, the main controller 801 drives the winder 511 to wind the green portion 10*g* of the thread 10 as illustrated in FIG. 14 at a position "a1" at which an embroidery of block B1 has been completed as illustrated in FIG. 14. Thus, a red portion 10*r* of the thread 10 to be used for broidering the next block B2 is positioned. The thread cutter 521 as described in above embodiments may be used to cut, collect, and remove the wound thread 10.

Similarly, as illustrated in FIG. 13, the main controller 801 drives the winder 511 to wind and remove the red portion 10*r* at a position "a2" at which an embroidery of the block B2 has been completed. Thus, a blue portion of the thread 10 to be used for embroidering the next block B3 is positioned. Further, the main controller 801 drives the winder 511 to wind and remove the blue portion at a position "a3" at which an embroidery of the block B3 has been completed.

At the time of completion of embroidery of the block B3, even when the breakage of the thread 10 occurs in the blue portion of the block B3, for example, the thread cutter 521 cuts the thread 10 for each block B1, B2 and B3 as described above. Thus, the embroidery device 100 can restart the embroidery from a start point of the block B3. Thus, the embroidery device 100 can easily restarts the sewing process when the thread 10 is broken.

Thus, there is no need to change the needle 410 in order to change the color of the thread 10 when dyeing and embroidery (sewing) are performed in parallel. Thus, the embroidery device 100 can continuously perform embroidery without performing thread cutting over a long period of time. However, the sewing process has to be redone over a long section when the thread 10 is broken in the middle (on the way) of the sewing process. Further, a positional deviation between a dyed portion and an embroidered portion of the thread 10 is accumulated and becomes a large deviation.

Therefore, the embroidery device 100 includes the remover 500 to remove the excess portion of the thread 10 each time the color is changed while a length of the thread 10 to be dyed in one color (dyeing length) is made longer than a length of the thread 10 of said one color to be continuously sewn on the medium 20 (embroidery length) in the fifth embodiment. Thus, it becomes sufficient to change the color of the thread 10 from the color of broken thread 10 when the thread 10 is broken in the middle of the sewing process.

An embroidery device 100 according to a sixth embodiment of the present disclosure is described with reference to FIGS. 15 and 16.

Figure 15:
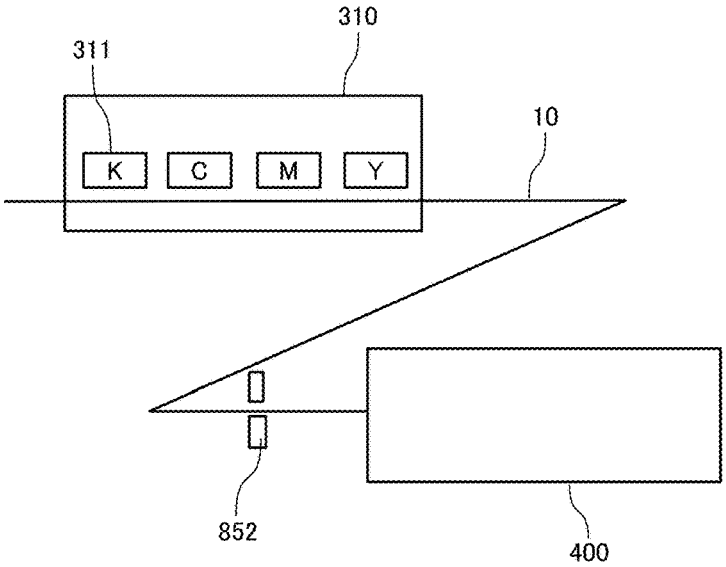
FIG. 15 is a schematic partial side view of the embroidery device according to a sixth embodiment of the present disclosure.
Figure 16A:
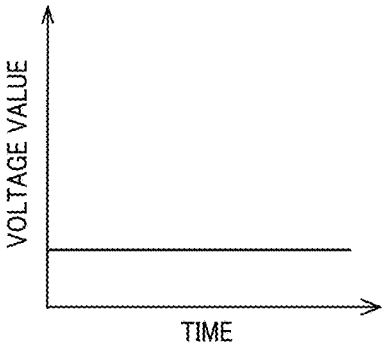
FIGS. 16A and 16B are graphs illustrating an effect of the embroidery device according to the sixth embodiment.
Figure 16B:
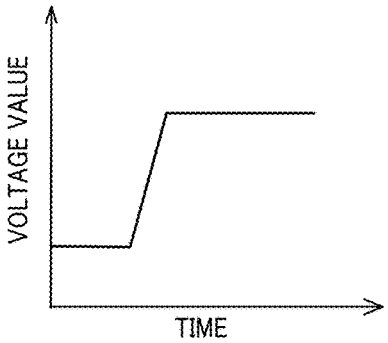

FIG. 15 is a schematic partial side view of the embroidery device 100 according to the sixth embodiment. FIGS. 16A and 16B are graphs illustrating an effect of the embroidery device 100 according to the sixth embodiment.

The embroidery device 100 according to the sixth embodiment includes the liquid application unit 310 of the dyeing unit 300. The liquid application unit 310 includes, for example, multiple head 311 (liquid discharge heads) that respectively discharge liquids of different colors of Yellow (Y), Magenta (M), Cyan (C), and Black (K) from right to left in FIG. 15. The embroidery device 100 includes the breakage detector 852 as described above between the liquid application unit 310 and the embroidery unit 400.

The breakage detector 852 is, for example, a photoelectric effect type sensor. When the thread 10 is not broken (normal state), the breakage detector 852 outputs (detects) a constant voltage value as illustrated in FIG. 16A. When the thread 10 is broken (abnormal state), the breakage detector 852 outputs (detects) a voltage value that rapidly increases as illustrated in FIG. 16B. Thus, the breakage detector 852 can detect a breakage of the thread 10.

The main controller 801 as described in the first embodiment stops the dyeing process of the dyeing unit 300 and stops the embroidery process of the embroidery unit 400 (sewing unit) when the breakage detector 852 detects breakage of the thread 10. At this time, the main controller 801 stores a broken portion and a degree of progress of the embroidery process so that the main controller 801 can restart the embroidery process from the broken portion again.

Thus, the embroidery device 100 according to the sixth embodiment restarts the dyeing process and the embroidery process (sewing process) from a stopped position at which the dyeing process and the embroidery process are stopped after an abnormal portion is removed by the remover 500.

Thus, the embroidery device 100 according to the sixth embodiment can obtain an output object (embroidered medium 20) without wasting the medium 20 and manufacturing time.

In the present disclosure, "liquid" discharged from a head is not particularly limited as long as the liquid has a viscosity and surface tension of degrees dischargeable from the head.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Each of the functions of the described embodiments such as the main controller 801 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. An embroidery device comprising:

a needle including a hole through which a linear structure dyed in different colors has been passed;

an embroidery structure to move the needle to perform a sewing process on a medium with the linear structure dyed in the different colors;

a remover to remove the linear structure in a vicinity of the needle, the remover comprising a winder to wind the linear structure that has been passed through the needle; and circuitry configured to:

control the winder to wind the linear structure until a color of the linear structure changes to a predetermined color at a winding position, and control the remover to remove the linear structure wound by the winder.

2. The embroidery device according to claim 1, wherein the remover comprises a winder including a clamp configured to clamp the linear structure and rotate to wind the linear structure that has been passed through the needle.

3. The embroidery device according to claim 2, further comprising:

circuitry configured to:

control the winder to wind the linear structure until a color of the linear structure changes to a predetermined color at a winding position;

control the winder to move from the winding position to a standby position; and control the embroidery structure to start the sewing process.

4. The embroidery device according to claim 2, further comprising:

circuitry configured to:

control the embroidery structure to temporarily stop the sewing process when a command of changing a color of the linear structure is received during the sewing process;

control the winder to wind the linear structure until a color of the linear structure changes to a predetermined color; and control the embroidery structure to restart the sewing process.

5. The embroidery device according to claim 1, wherein the remover comprises a drawer including a pair of rollers to draw the linear structure that has been passed through the needle.

6. The embroidery device according to claim 5, further comprising:

circuitry configured to:

control the drawer to draw the linear structure until a color of the linear structure changes to a predetermined color at a drawing position;

control the drawer to move from the drawing position to a standby position; and control the embroidery structure to start the sewing process.

7. The embroidery device according to claim 5, further comprising:

circuitry configured to:

control the embroidery structure to temporarily stop the sewing process when a command of changing a color of the linear structure is received during the sewing process;

control the drawer to draw the linear structure until a color of the linear structure changes to a predetermined color; and control the embroidery structure to restart the sewing process.

8. The embroidery device according to claim 1, wherein the remover comprises a cutter to cut the linear structure.

9. The embroidery device according to claim 8, wherein the remover comprises:

a winder including a clamp configured to clamp the linear structure and rotate to wind the linear structure that has been passed through the needle, and the cutter includes:

a first cutter between the needle and the winder in a moving direction of the needle toward the medium; and a second cutter between the winder and the medium in the moving direction, and the remover is movable between a winding position in the vicinity of the needle and a standby position away from the needle.

10. The embroidery device according to claim 8, further comprising:

circuitry configured to:

control the embroidery structure to perform the sewing process; and control the cutter to move to a cutting position to cut the linear structure after the sewing process.

11. The embroidery device according to claim 1, further comprising:

a color detector to detect a color of the linear structure.

12. The embroidery device according to claim 1, further comprising:

a dyer to dye the linear structure in different colors; and circuitry configured to:

control the dyer to dye the linear structure in a predetermined color for a dyeing length, the dyeing length longer than an embroidery length of the linear structure dyed in the predetermined color to be embroidered on the medium by the embroidery structure.

13. The embroidery device according to claim 1, further comprising:

a breakage detector to detect a breakage of the linear structure.

14. The embroidery device according to claim 1, further comprising:

circuitry configured to:

control the remover to move to a removing position in the vicinity of the needle to remove the linear structure at a start of the sewing process by the embroidery structure.

15. The embroidery device according to claim 12, wherein the dyer includes a head to discharge liquids of the different colors.

16. The embroidery device according to claim 15, wherein the head includes multiple heads to respectively discharge liquids of the different colors.

17. The embroidery device according to claim 1, wherein the embroidery structure includes multiple needles.

* * * * *